US009065228B2

(12) United States Patent
Nishimura et al.

(10) Patent No.: US 9,065,228 B2
(45) Date of Patent: Jun. 23, 2015

(54) CONNECTOR

(71) Applicants: JAPAN AVIATION ELECTRONICS INDUSTRY, LIMITED, Shibuya-ku, Tokyo (JP); JAE ELECTRONICS, INC., Irvine, CA (US)

(72) Inventors: Takayuki Nishimura, Tokyo (JP); Daisuke Machihara, Irvine, CA (US)

(73) Assignees: JAPAN AVIATION ELECTRONICS INDUSTRY, LIMITED, Tokyo (JP); JAE ELECTRONICS, INC., Irvine, CA (US)

( * ) Notice: Subject to any disclaimer, the term of this patent is extended or adjusted under 35 U.S.C. 154(b) by 0 days.

(21) Appl. No.: 14/228,001

(22) Filed: Mar. 27, 2014

(65) Prior Publication Data

US 2015/0140840 A1 May 21, 2015

Related U.S. Application Data

(60) Provisional application No. 61/907,211, filed on Nov. 21, 2013.

(51) Int. Cl.
*H01R 12/00* (2006.01)
*H01R 12/79* (2011.01)
(Continued)

(52) U.S. Cl.
CPC ..... *H01R 12/79* (2013.01); *H01R 12/7082* (2013.01); *H01R 12/716* (2013.01); *H01R 12/775* (2013.01)

(58) Field of Classification Search
CPC ..... H01R 12/716
USPC ..... 439/74, 607.01
See application file for complete search history.

(56) References Cited

U.S. PATENT DOCUMENTS 6,884,089 B2 4/2005 Obikane et al.
7,052,286 B2 * 5/2006 Zhang ..... 439/74
(Continued)

FOREIGN PATENT DOCUMENTS

EP 1403974 A1 3/2004
JP 2004-127572 A 4/2004
(Continued)

OTHER PUBLICATIONS

Extended European Search Report dated Feb. 26, 2015, issued in counterpart European Application No. 14191560.3.

*Primary Examiner* — Tho D Ta
(74) *Attorney, Agent, or Firm* — Holtz, Holtz, Goodman & Chick PC

(57) ABSTRACT

A connector is mateable with a mating connector along an up-down direction under a mounted state where the connector is mounted on a circuit board. The mating connector is mounted on a mating circuit board. The connector comprises a housing, a regulation member and a contact. The regulation member has an insulation portion and a metal portion. The insulation portion is supported by the metal portion. The metal portion is fixed to the housing. The contact is press-fit in the housing from below to be held by the housing. The contact has a connection portion and a resilient portion. The connection portion is fixed to an upper surface of the circuit board under the mounted state. The resilient portion has a lower-end portion. The lower-end portion of the resilient portion is located below the connection portion and located right above the insulation portion. The resilient portion is resiliently deformable downward.

13 Claims, 10 Drawing Sheets

(51) Int. Cl.

| | |
|---|---|
| ***H01R 12/70*** | (2011.01) |
| ***H01R 12/71*** | (2011.01) |
| ***H01R 12/77*** | (2011.01) |

(56) References Cited

U.S. PATENT DOCUMENTS

| | | | | |
|---|---|---|---|---|
| 7,585,185 | B2 * | 9/2009 | Obikane | 439/607.01 |
| 7,717,719 | B2 | 5/2010 | Miyazaki et al. | |
| 2002/0119702 | A1 | 8/2002 | Chen | |
| 2005/0042924 | A1 | 2/2005 | Zhang et al. | |
| 2007/0232145 | A1 | 10/2007 | Wang | |
| 2008/0268708 | A1 | 10/2008 | Yamada et al. | |
| 2009/0061655 | A1 | 3/2009 | Miyazaki et al. | |
| 2013/0323971 | A1 | 12/2013 | Kimura | |

FOREIGN PATENT DOCUMENTS

| | | | |
|---|---|---|---|
| JP | 2006140111 | A | 6/2006 |
| JP | 2006-253159 | A | 9/2006 |
| JP | 2009-059620 | A | 3/2009 |
| JP | 2013-251217 | A | 12/2013 |
| WO | WO 2008/139554 | A1 | 11/2008 |

* cited by examiner

CONNECTOR

CROSS REFERENCE TO RELATED APPLICATIONS

This application claims the benefit of U.S. Provisional Application No. 61/907,211 filed Nov. 21, 2013, the contents of which are herein incorporated by reference in its entirety.

BACKGROUND OF THE INVENTION

This invention relates to a connector which is to be mounted on a circuit board and is mateable with a mating connector mounted on a mating circuit board.

For example, this type of connector is disclosed in JP-A 2009-59620 (Patent Document 1), the content of which is incorporated herein by reference.

As shown in FIG. 17, the socket (connector) of Patent Document 1 is mounted on a second printed board (circuit board). The connector is mateable, along an up-down direction, with a header (mating connector) mounted on a first printed board (mating circuit board). The connector comprises a socket contact (contact), while the mating connector comprises a header contact (mating contact). The contact is attached to the connector from below so that a part (resilient portion) of the contact is located right above the circuit board. Under a mated state where the connector and the mating connector are mated with each other, the resilient portion of the contact is brought into contact with the mating contact while pressed to be moved downward by the mating contact. The circuit board prevents the resilient portion from being excessively moved downward.

The circuit board and the mating circuit board of Patent Document 1 are apart from each other in the up-down direction by a distance (D) under the mated state. When the connector is installed in a small electronic apparatus such as a portable telephone, it is desirable that the distance (D) is as small as possible.

SUMMARY OF THE INVENTION

It is therefore an object of the present invention to provide a connector which enables a circuit board and a mating circuit board to have a reduced distance therebetween under a mated state, wherein the connector is mounted on the circuit board while a mating connector is mounted on the mating circuit board.

When the most part of the connector is located below an upper surface of the circuit board, the distance between the circuit board and the mating circuit board under the mated state can be reduced. Specifically, the circuit board is required to be formed with a receive portion which receives the connector. However, if the receive portion is a hole piercing the circuit board, a resilient portion of the connector might be excessively moved downward through the hole to be damaged. If the receive portion is a recess recessed from the upper surface of the circuit board, the circuit board is formed with a thin portion located under the recess. Accordingly, when the resilient portion is moved downward, the thin portion of the circuit board might be pressed by the resilient portion to be damaged.

According to the present invention, the distance between the circuit board and the mating circuit board under the mated state can be reduced while the aforementioned problems are overcome.

First aspect of the present invention provides a connector mateable with a mating connector along an up-down direction under a mounted state where the connector is mounted on a circuit board. The mating connector is mounted on a mating circuit board. The connector comprises a housing, a regulation member and a contact. The regulation member has an insulation portion made of an insulator and a metal portion made of a metal. The insulation portion is supported by the metal portion. The metal portion is fixed to the housing. The contact is press-fit in the housing from below to be held by the housing. The contact has a connection portion and a resilient portion. The connection portion is fixed to an upper surface of the circuit board under the mounted state. The resilient portion has a lower-end portion. The lower-end portion of the resilient portion is located below the connection portion and located right above the insulation portion of the regulation member. The resilient portion is resiliently deformable downward.

Second aspect of the present invention provides another connector mateable with a mating connector along an up-down direction under a mounted state where the connector is mounted on a circuit board. The mating connector is mounted on a mating circuit board. The connector comprises a housing, a regulation member and a contact. The regulation member has an insulation portion made of an insulator and a metal portion made of a metal. The insulation portion is supported by the metal portion. The metal portion has an attached portion. The attached portion is directly or indirectly fixed to the circuit board under the mounted state. The contact is press-fit in the housing from below to be held by the housing. The contact has a connection portion and a resilient portion. The connection portion is fixed to an upper surface of the circuit board under the mounted state. The resilient portion has a lower-end portion. The lower-end portion of the resilient portion is located below the connection portion and located right above the insulation portion of the regulation member. The resilient portion is resiliently deformable downward.

An appreciation of the objectives of the present invention and a more complete understanding of its structure may be had by studying the following description of the preferred embodiment and by referring to the accompanying drawings.

Figure 1:
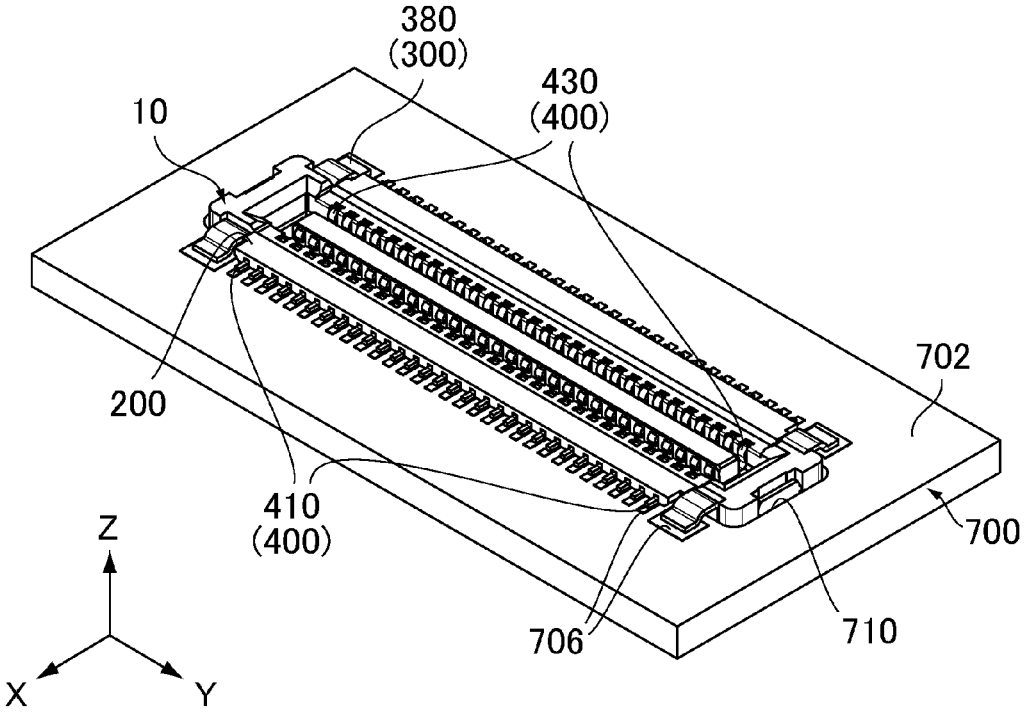
FIG. 1 is a perspective view showing a connector according to an embodiment of the present invention under a mounted state where the connector is mounted on a circuit board.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 9:
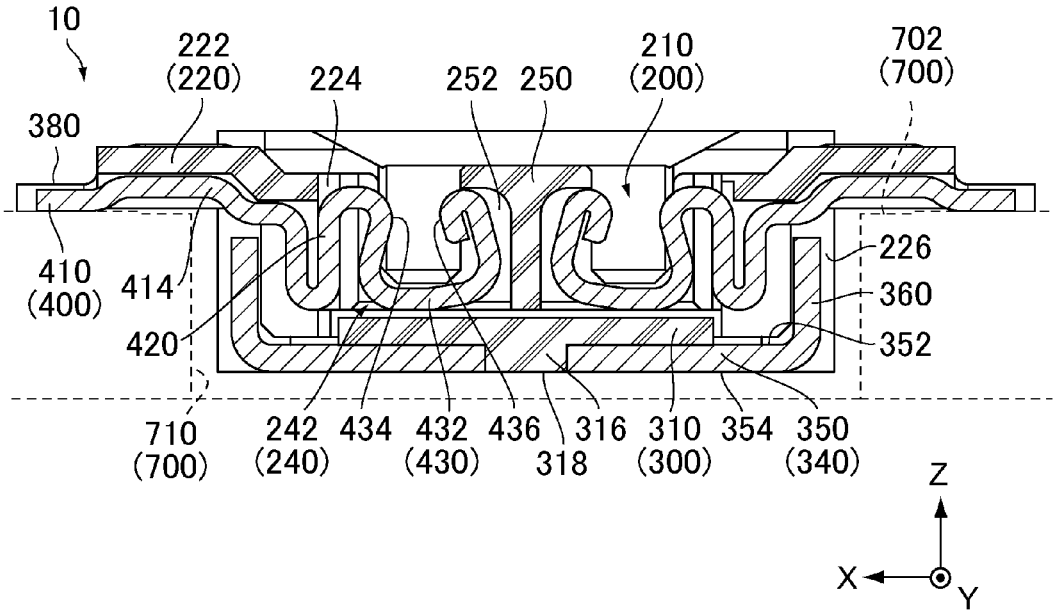
FIG. 9 is a cross-sectional view showing the connector of FIG. 6, taken along line IX-IX, wherein an outline of the circuit board under the mounted state is illustrated by dotted line.
Figure 10:
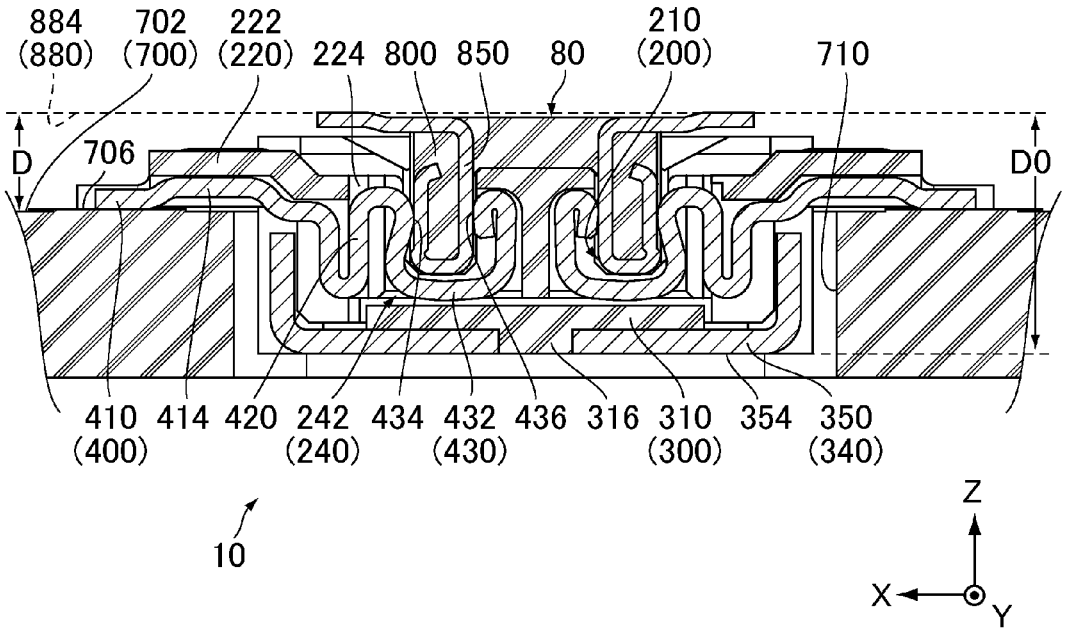
FIG. 10 is a cross-sectional view showing the connector of FIG. 1 and a mating connector mounted on a mating circuit board, wherein the connector and the mating connector are mated with each other, and wherein a mounted surface of the mating circuit board is illustrated by dotted line.

As shown in FIGS. 1, 9 and 10, a connector 10 according to an embodiment of the present invention is a board-to-board connector. In detail, the connector 10 is mateable with a mating connector 80 along an up-down direction (Z-direction) under a mounted state where the connector 10 is mounted on a circuit board 700.

As shown in FIG. 10, when the mating connector 80 is used, the mating connector 80 is mounted on a mating circuit board 880. The connector 10 and the mating connector 80 are mateable with each other under a state where a mount surface (upper surface) 702 of the circuit board 700 and a mount surface 884 of the mating circuit board 880 face each other. The mating circuit board 880 according to the present embodiment is a Flexible Printed Circuit (FPC). However, the mating circuit board 880 may not be an FPC.

As shown in FIG. 10, the mating connector 80 comprises a mating housing 800 made of an insulator and a plurality of mating contacts 850 each made of a conductor. The mating contacts 850 are connected to conductive patterns (not shown) of the mating circuit board 880, respectively.

Figure 2:
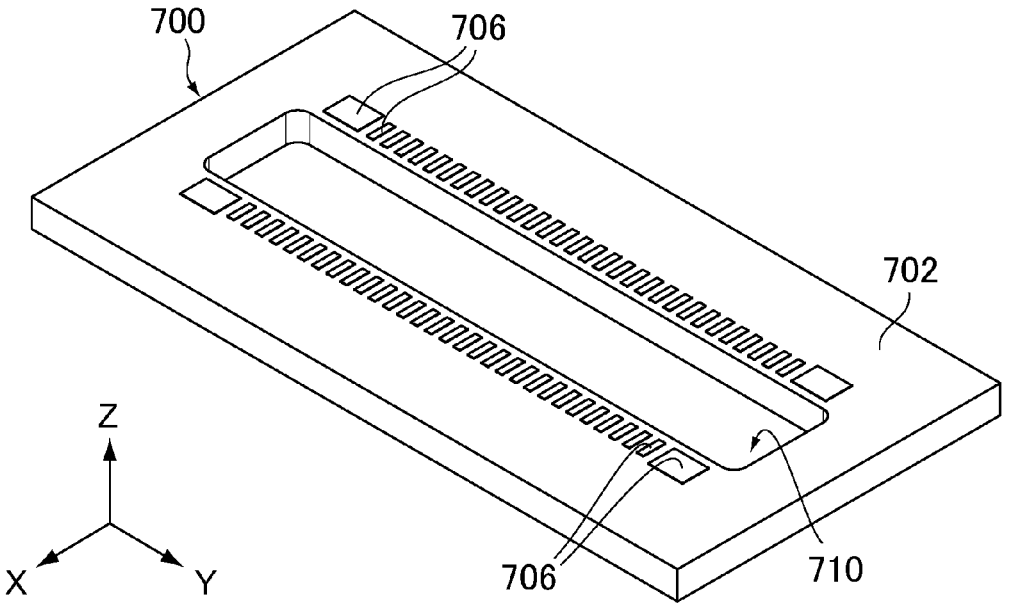
FIG. 2 is a perspective view showing the circuit boar of FIG. 1.

As shown in FIGS. 1 and 2, the circuit board 700 is formed with a receive portion 710. The connector 10 is received in the receive portion 710 under the mounted state. The receive portion 710 according to the present embodiment is a hole piercing the circuit board 700 in the Z-direction. However, the receive portion 710 may be a recess recessed downward (in the negative Z-direction) from the upper surface 702 of the circuit board 700, provided that the receive portion 710 can sufficiently receive the connector 10.

The upper surface 702 of the circuit board 700 is provided with a plurality of conductive pads 706. The conductive pads 706 are arranged in two rows which put the receive portion 710 therebetween in a width direction (X-direction).

Figure 3:
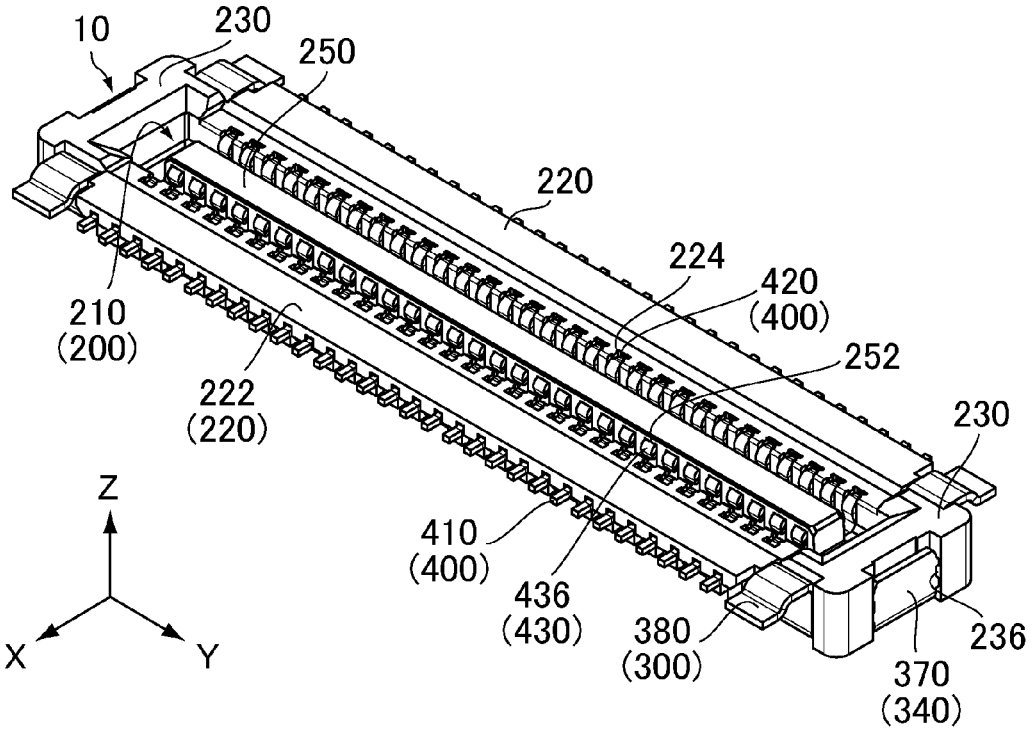
FIG. 3 is a perspective view showing the connector of FIG. 1 under a state where the connector is not mounted on the circuit board.
Figure 8:
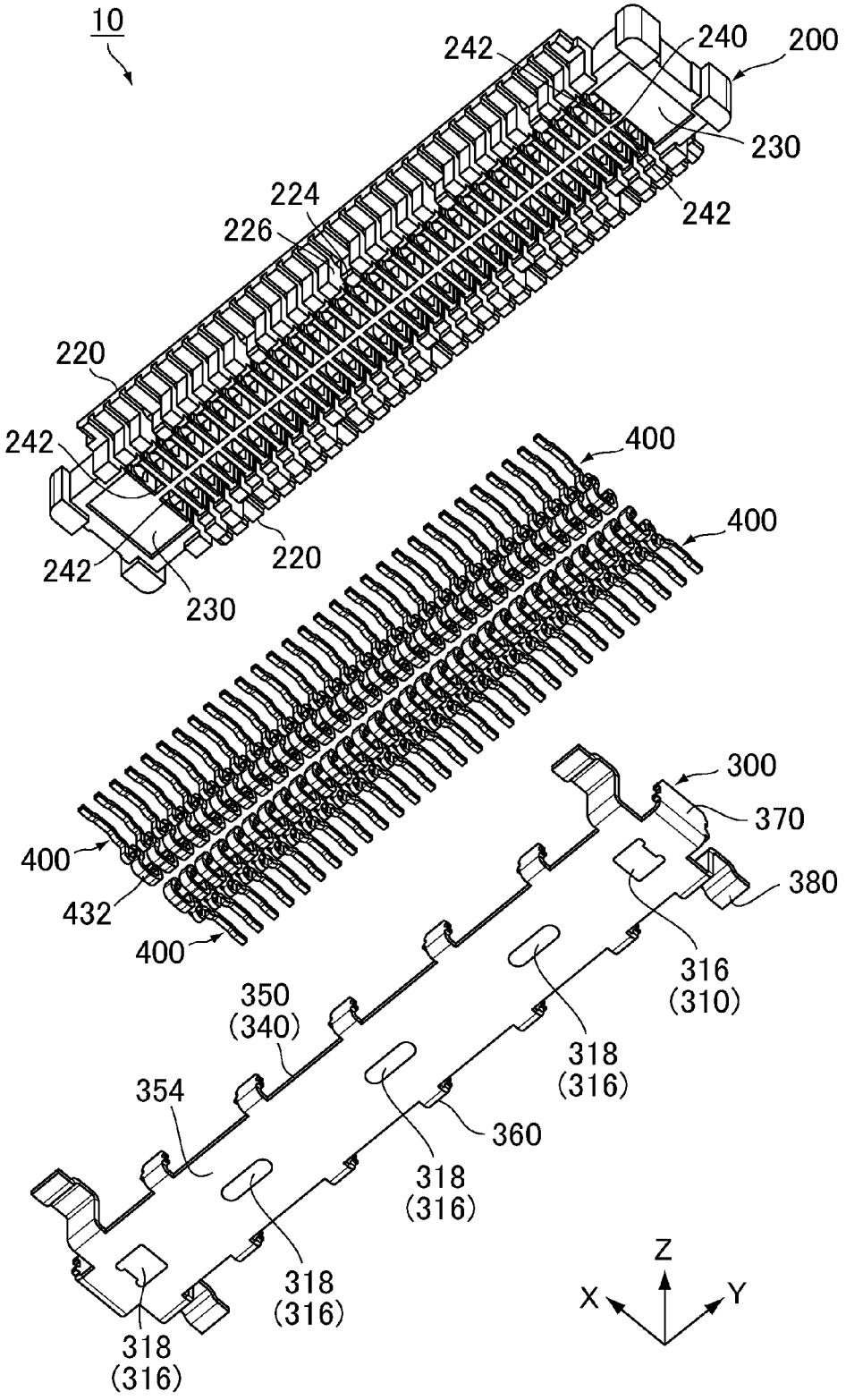
FIG. 8 is an exploded, perspective view showing the connector of FIG. 3 from below.

As shown in FIGS. 3 and 8, the connector 10 comprises a housing 200 made of an insulator, a regulation member 300 and a plurality of contacts 400 each made of a conductor.

As shown in FIGS. 3, 4, 9 and 10, the housing 200 is formed with an accommodation portion 210. The accommodation portion 210 accommodates a part of the mating connector 80 under a mated state where the connector 10 and the mating connector 80 are mated with each other.

Figure 4:
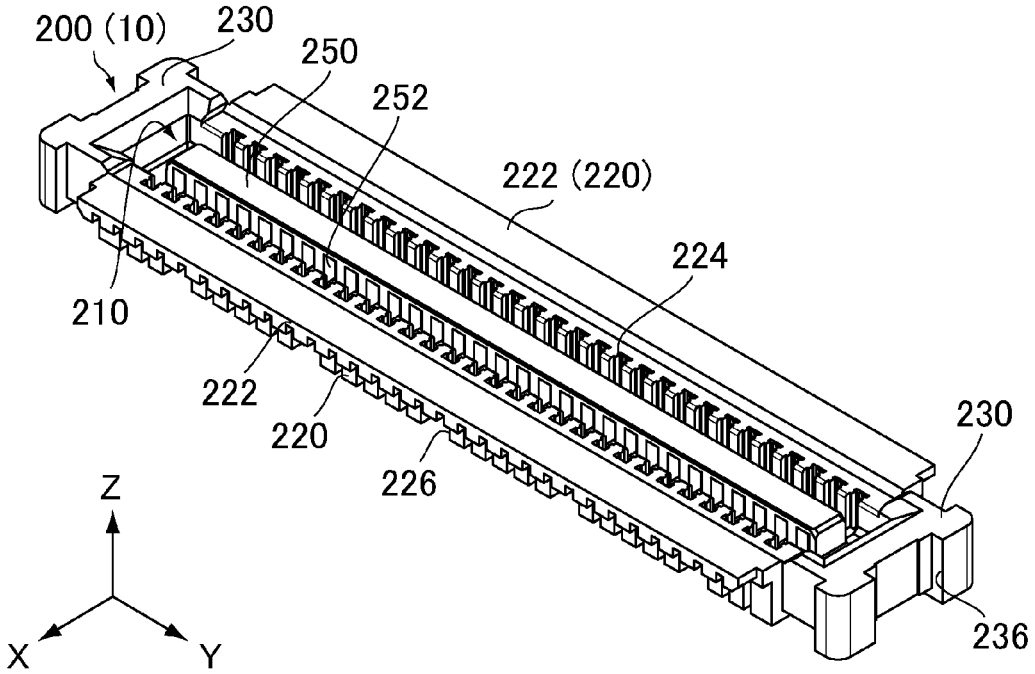
FIG. 4 is a perspective view showing a housing of the connector of FIG. 3.

As shown in FIGS. 4 and 8, the housing 200 has two outer walls 220, two coupling walls 230, a bottom portion 240 and a protruding portion 250. The outer walls 220 and the coupling walls 230 surround the accommodation portion 210 in the XY-plane. In detail, the outer walls 220 extend long in a pitch direction (Y-direction). The coupling walls 230 are located at opposite ends of the housing 200 in the Y-direction, respectively. In the width direction (X-direction), each of the coupling walls 230 couples end portions which are the respective portions of the outer walls 220 in the Y-direction. The bottom portion 240 is located in the vicinity of a lower end (negative Z-side end) of the housing 200. The bottom portion 240 is formed with a plurality of attaching holes 242 which correspond to the contacts 400, respectively. The protruding portion 250 is provided at the middle part of the housing 200 in the X-direction. The protruding portion 250 is surrounded by the accommodation portion 210 in the XY-plane. The protruding portion 250 protrudes upward (in the positive Z-direction) from the bottom portion 240 while extending long in the Y-direction.

As shown in FIGS. 3, 4 and 9, each of the outer walls 220 is formed with a stop wall 222. The stop wall 222 is located at an upper end (the positive Z-side end) of the outer wall 220. The stop wall 222 extends long in the Y-direction while protruding outward in the X-direction. Each of the outer walls 220 is further formed with a plurality of holding portions 224 which correspond to the contacts 400, respectively. The protruding portion 250 is formed with a plurality of ditches 252 which correspond to the contacts 400, respectively. The ditches 252 are provided at opposite sides of the protruding portion 250 in the X-direction. The holding portion 224 and the ditch 252 face each other across the accommodation portion 210.

As can be seen from FIG. 8, the contacts 400 are attached to the housing 200 from below through the attaching holes 242 of the bottom portion 240. The contacts 400 are arranged in two rows extending in the Y-direction.

Figure 5:
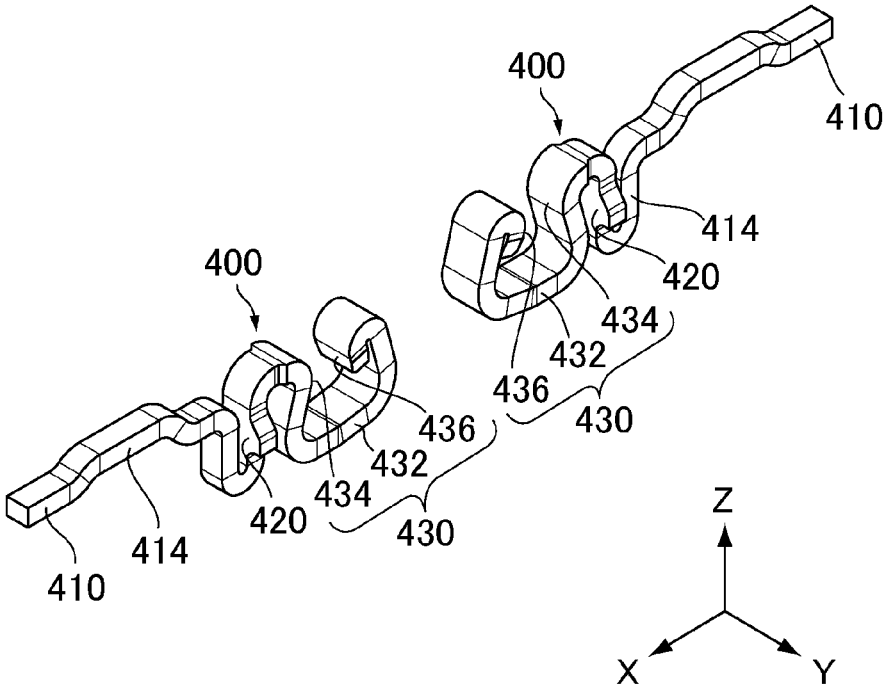
FIG. 5 is a perspective view showing contacts of the connector of FIG. 3.

As shown in FIG. 5, the contact 400 has a connection portion 410, a stopped portion 414, a held portion 420 and a resilient portion 430. The connection portion 410 extends in the X-direction. The stopped portion 414 extends inward in the X-direction from the connection portion 410 and, then, extends downward. The held portion 420 extends upward from the stopped portion 414. Thus, the stopped portion 414 couples the connection portion 410 and the held portion 420 with each other. The resilient portion 430 extends inward in the X-direction from the held portion 420. The resilient portion 430 has a U-like shape. In detail, the resilient portion 430 has a lower-end portion 432, a first contact portion (contact portion) 434 and a second contact portion (contact portion) 436. The first contact portion 434 and the second contact portion 436 extend roughly in the Z-direction. The lower-end portion 432 couples the lower end of the first contact portion 434 with the lower end of the second contact portion 436 in the X-direction.

As shown in FIGS. 3 and 9, the held portion 420 of the contact 400 is press-fit in and held by the holding portion 224 of the housing 200. The stopped portion 414 is located under the stop wall 222. The connection portion 410 extends outward in the X-direction from the stopped portion 414 to protrude outward of the housing 200. Under the mounted state, the connection portion 410 is fixed to the conductive pad 706 (see FIG. 1) of the upper surface 702 of the circuit board 700 by soldering or the like to be connected to a conductive pattern (not shown) of the circuit board 700.

As shown in FIG. 9, the first contact portion 434 extends downward from the held portion 420 while partially protruding into the accommodation portion 210. The lower-end portion 432 extends inward in the X-direction to the ditch 252 of the protruding portion 250 from the lower end of the first contact portion 434. The second contact portion 436 extends upward through the ditch 252 from the lower-end portion 432 to partially protrude into the accommodation portion 210. The lower-end portion 432 is located below the connection portion 410. Thus, the lower-end portion 432 is located below the upper surface 702 of the circuit board 700 under the mounted state. The resilient portion 430 is supported by the held portion 420 to be resiliently deformable. Especially, the resilient portion 430 is resiliently deformable downward. Accordingly, the lower-end portion 432 is movable downward.

As can be seen from FIG. 10, when the connector 10 is mated with the mating connector 80, the first contact portion 434 and the second contact portion 436 are brought into contact with the mating contact 850 while pushed downward by the mating contact 850. In detail, the mating contact 850 is brought into contact with a contact section that is constituted of a part of the first contact portion 434 and a part of the second contact portion 436. The contact 400 according to the present embodiment is formed by punching out and bending a single metal plate. Accordingly, the contact section has a wide area. The thus-formed contact 400 can be reliably brought into contact with the mating contact 850.

Under the mounted state, the most part of the connector 10 is received within the receive portion 710 of the circuit board 700 and is located below the upper surface 702. In other words, the connector 10 hardly protrudes upward from the upper surface 702 under the mounted state. Accordingly, under the mated state, a distance (D) between the upper surface 702 of the circuit board 700 and the mount surface 884 of the mating circuit board 880 in the Z-direction is small. In detail, under the mated state, the lower end of the housing 200 is apart from the mount surface 884 of the mating circuit board 880 by a distance (D0) in the Z-direction. If the connector 10 is mounted on the upper surface 702 of the circuit board 700 like an existing connector, the upper surface 702 of the circuit board 700 is apart from the mount surface 884 of the mating circuit board 880 by the distance (D0). The distance (D) according to the present embodiment is less than a half of the distance (D0).

According to the present embodiment, the held portion 420 of the contact 400 is press-fit in the holding portion 224 of the housing 200 from below to be held by the holding portion 224. Moreover an upward movement of the contact 400 is prevented by the stop wall 222. In detail, if the contact 400 is slightly moved upward, the stopped portion 414 of the contact 400 is stopped by the stop wall 222. Accordingly, when the mating connector 80 is detached upward, the contact 400 does not come off the housing 200.

Figure 7:
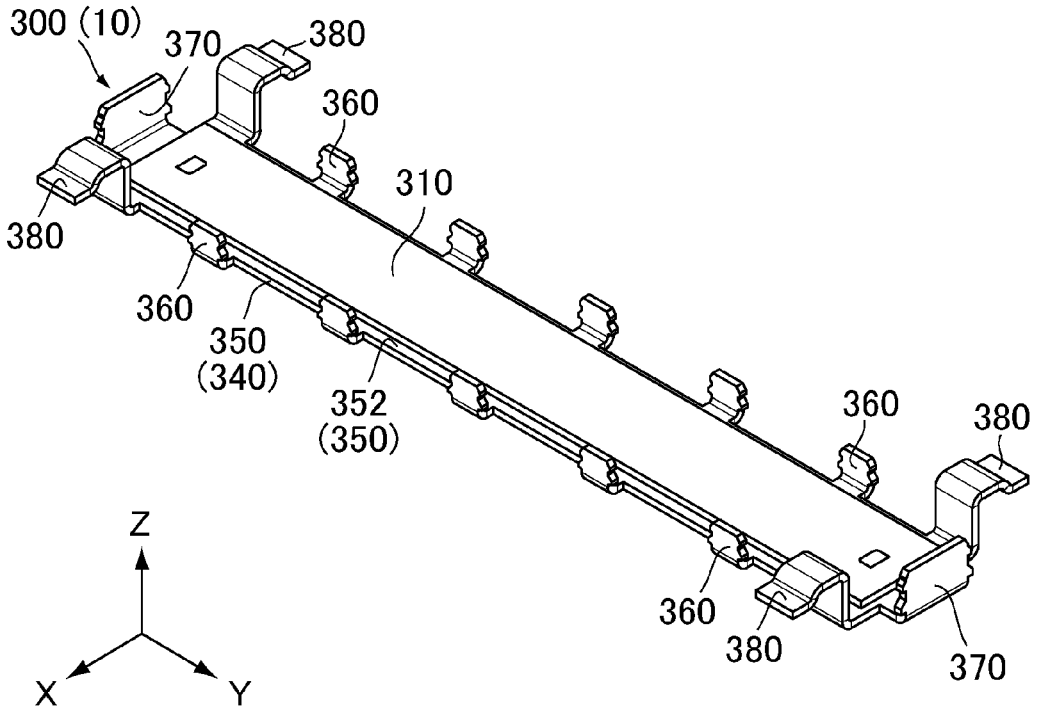
FIG. 7 is a perspective view showing a regulation member of the connector of FIG. 3.

As shown in FIGS. 7 and 8, the regulation member 300 has an insulation portion 310 made of an insulator such as a resin or a rubber and a metal portion 340 made of a metal. The metal portion 340 according to the present embodiment has a body portion 350, a plurality of (according to the present embodiment, ten) first fixed portions (fixed portions) 360, two second fixed portions (fixed portions) 370 and four attached portions 380.

According to the present embodiment, each of the insulation portion 310 and the body portion 350 has a plate-like shape perpendicular to the Z-direction. Thus, the body portion 350 has an upper surface 352 and a lower surface 354 perpendicular to the Z-direction. However, each of the insulation portion 310 and the body portion 350 may be oblique to the Z-direction by some amount. In other words, each of the insulation portion 310 and the body portion 350 only needs to intersect the Z-direction.

As can be seen from the FIGS. 7 to 9, the insulation portion 310 is fixed on the body portion 350. However, the insulation portion 310 may not be fixed to the body portion 350, provided that the insulation portion 310 is supported by the body portion 350. According to the present embodiment, the insulation portion 310 and the body portion 350 are integrally formed via insert-molding so that the insulation portion 310 is formed with five predetermined portions 316. Each of the predetermined portions 316 pierces the body portion 350 in the Z-direction so that the insulation portion 310 is securely fixed to the body portion 350. The lower surface 318 of the predetermined portion 316 is flush with the lower surface 354 of the body portion 350. In other words, the lower surface 354 of the body portion 350 is not covered with the insulation portion 310. Accordingly, the regulation member 300 has a relatively small thickness.

As shown in FIG. 7, five of the first fixed portions 360 are provided on each of sides of the body portion 350 in the X-direction while one of the second fixed portions 370 is provided on each of ends of the body portion 350 in the Y-direction. In addition, two of the attached portions 380 are provided on each of the sides of the body portion 350 in the X-direction. The attached portion 380 is located in the vicinity of the first fixed portion 360. The first fixed portions 360 and the second fixed portions 370 protrude upward from the body portion 350. The attached portions 380 protrude upward from the body portion 350 and, then, extend outward in the X-direction.

Figure 6:
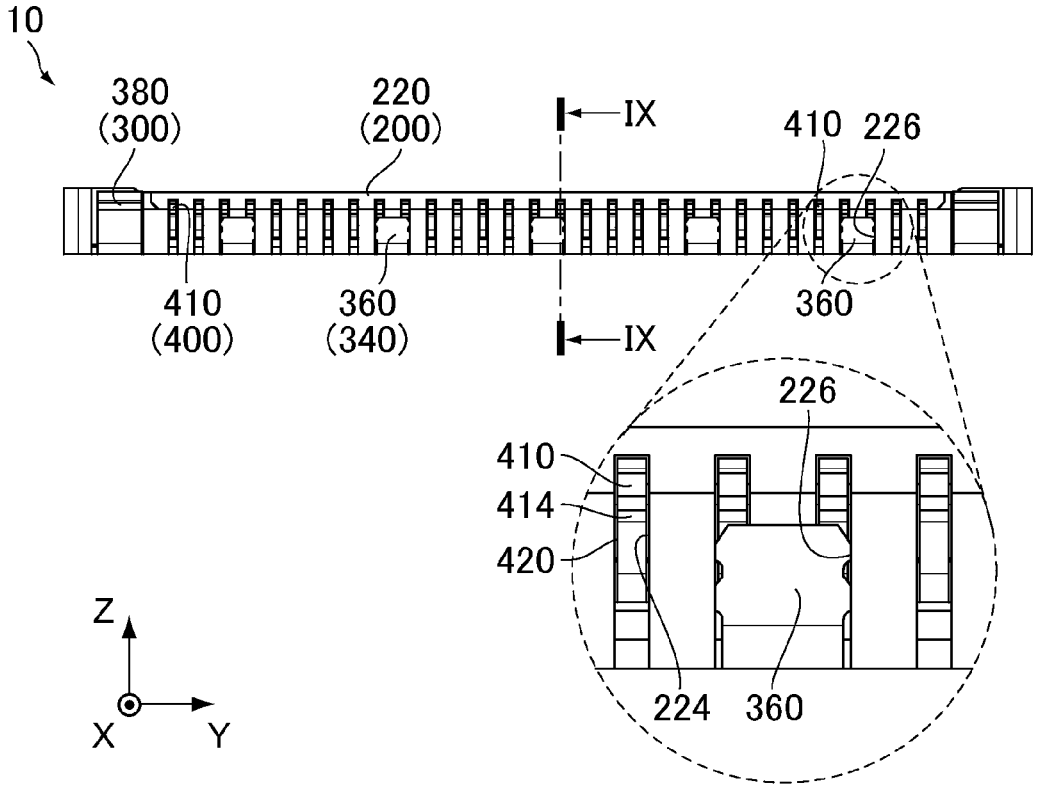
FIG. 6 is a side view showing the connector of FIG. 3, wherein a part of the connector (a part encircled by dotted line) is enlarged to be illustrated.

As shown in FIGS. 3 and 6, the first fixed portions 360 and the second fixed portions 370 of the metal portion 340 are press-fit in the housing 200 to be fixed to the housing 200. The attached portions 380 sandwich the outer walls 220 in the X-direction. Thus, the metal portion 340 is fixed to the housing 200. In detail, the outer walls 220 of the housing 200 are formed with a plurality of first fixing portions (fixing portions) 226 which correspond to the first fixed portions 360, respectively. Moreover, each of the coupling walls 230 is formed with a second fixing portion (fixing portion) 236 corresponding to the second fixed portion 370. The first fixed portions 360 are press-fit in the first fixing portions 226 from below, respectively, while the second fixed portions 370 are press-fit in the second fixing portions 236 from below, respectively. However, the metal portion 340 may be fixed to the housing 200 differently. For example, each of the first fixed portions 360 and the second fixed portions 370 may be hooked on a part of the housing 200. In this case, each of the first fixed portions 360 and the second fixed portions 370 may have a hook-like shape.

As shown in FIGS. 9 and 10, the lower-end portion 432 of the resilient portion 430 is located right above the insulation portion 310 of the regulation member 300. The lower-end portion 432 is brought into contact with the insulation portion 310 even when the resilient portion 430 is maximally resiliently deformed downward. Accordingly, the contact 400 can be prevented from being unintentionally brought into contact with a conductor outside of the connector 10. Moreover, even when the contact 400 is pushed downward by the mating contact 850, the lower-end portion 432 does not move downward beyond the insulation portion 310. Accordingly, plastic deformation of the resilient portion 430 due to an excessive movement of the lower-end portion 432, or damage of the contact 400, can be prevented. In addition, the insulation portion 310 is supported and reinforced by the metal portion 340 from below. Accordingly, the regulation member 300 can be prevented from being damaged by a pressing force applied from the lower-end portion 432. In addition, since the first fixed portions 360 and the second fixed portions 370 which surround the body portion 350 in the XY-plane (see FIG. 7) are fixed to the housing 200, the metal portion 340 is securely fixed to the housing 200. Accordingly, the pressing force applied from the lower-end portion 432 is received by the regulation member 300 so as not to largely affect the circuit board 700.

As shown in FIG. 1, according to the present embodiment, the attached portions 380 of the regulation member 300 are directly fixed to the upper surface 702 of the circuit board 700 under the mounted state. Accordingly, even if the pressing force applied from the lower-end portion 432 is large, the regulation member 300 can be prevented from coming off the housing 200.

As can be seen from FIGS. 8 and 9, the body portion 350 of the metal portion 340 according to the present embodiment shields the housing 200 from below. Moreover, the attached portions 380 of the metal portion 340 are fixed to conductive pads 706 of the upper surface 702 of the circuit board 700 by soldering or the like to be grounded to ground pattern (not shown) of the circuit board 700. Accordingly, the metal portion 340 electromagnetically shields the connector 10 from below. In other words, the metal portion 340 according to the present embodiment can prevent electromagnetic interference (EMI).

As can be seen from FIG. 8, according to the present embodiment, the regulation member 300 completely covers the attaching holes 242 of the bottom portion 240 of the housing 200. Accordingly, although the receive portion 710 pierces the circuit board 700 (see FIG. 2), coating agent or dust can be prevented from entering into the inside of the connector 10. However, the regulation member 300 may be formed differently when the regulation member 300 is required only to regulate the downward movement of the lower-end portion 432 of the contact 400. For example, the body portion 350 of the metal portion 340 may be formed to have a comb-like shape or a net-like shape, provided that the insulation portion 310 can be reinforced. The insulation portion 310 may be formed only right under the lower-end portions 432. Moreover, the insulation portion 310 may be, for example, a thin insulation coating, provided that the contact 400 can be prevented from being short-circuited.

The connector 10 according to the present embodiment may be modified variously in addition to the already described modifications.

Figure 11:
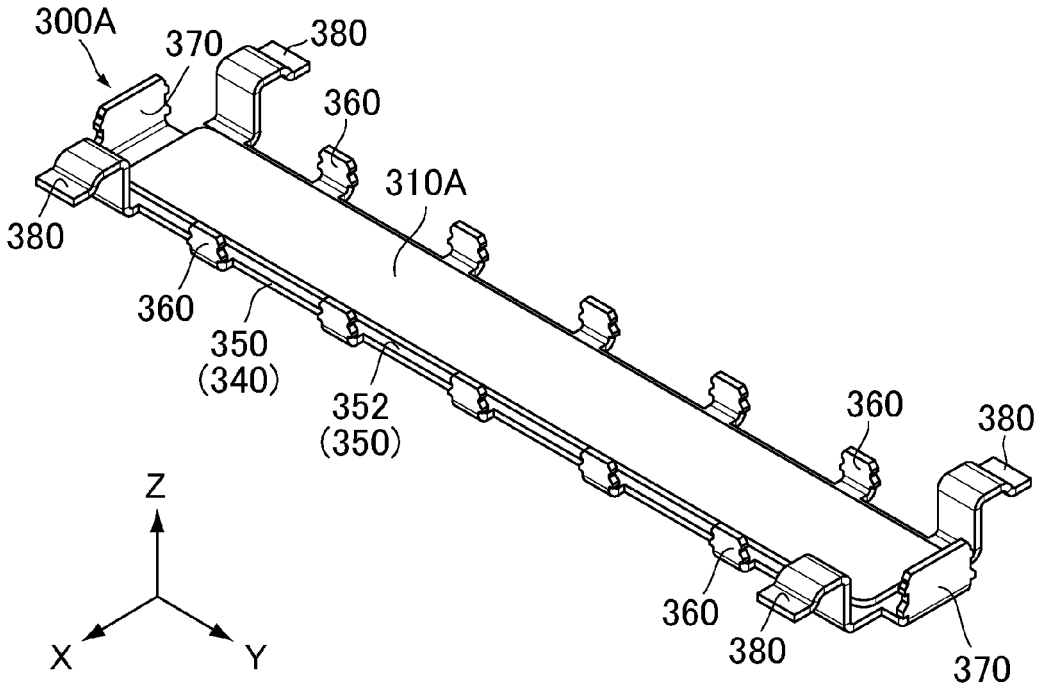
FIG. 11 is a perspective view showing a modification of the regulation member of FIG. 7.

As shown in FIG. 11, a regulation member 300A according to a modification has an insulation portion 310A and the metal portion 340, wherein the insulation portion 310A is slightly different from the insulation portion 310 (see FIG. 7) according to the present embodiment while the metal portion 340 is same as that of the present embodiment. Similar to the insulation portion 310, the insulation portion 310A has a plate-like shape and is fixed on the body portion 350. However, unlike the insulation portion 310, the insulation portion 310A is an insulating tape fixed to the upper surface 352 of the body portion 350. In detail, the insulation portion 310A is adhered or glued to the upper surface 352. The effect same as that of the present embodiment can be also obtained by the thus-formed regulation member 300A.

Figure 12:
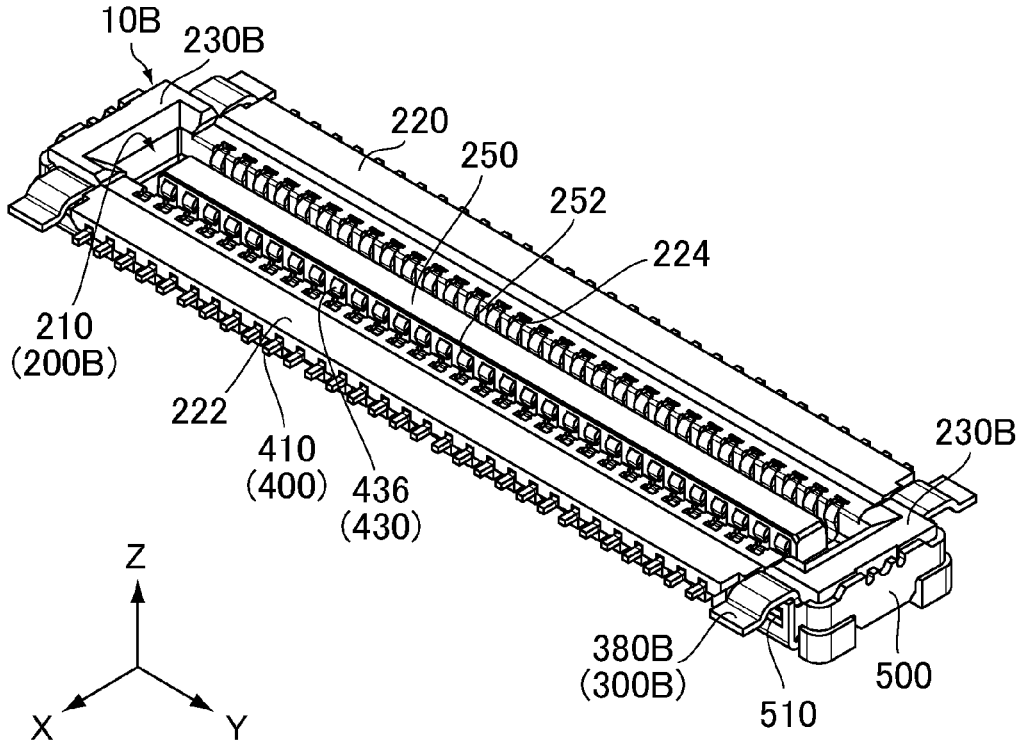
FIG. 12 is a perspective view showing a modification of the connector of FIG. 3.

As shown in FIG. 12, the connector 10B according to another modification comprises a housing 200B, a regulation member 300B, a plurality of the contacts 400 and two holddowns 500, wherein the contacts 400 are same as those of the present embodiment.

Figure 16:
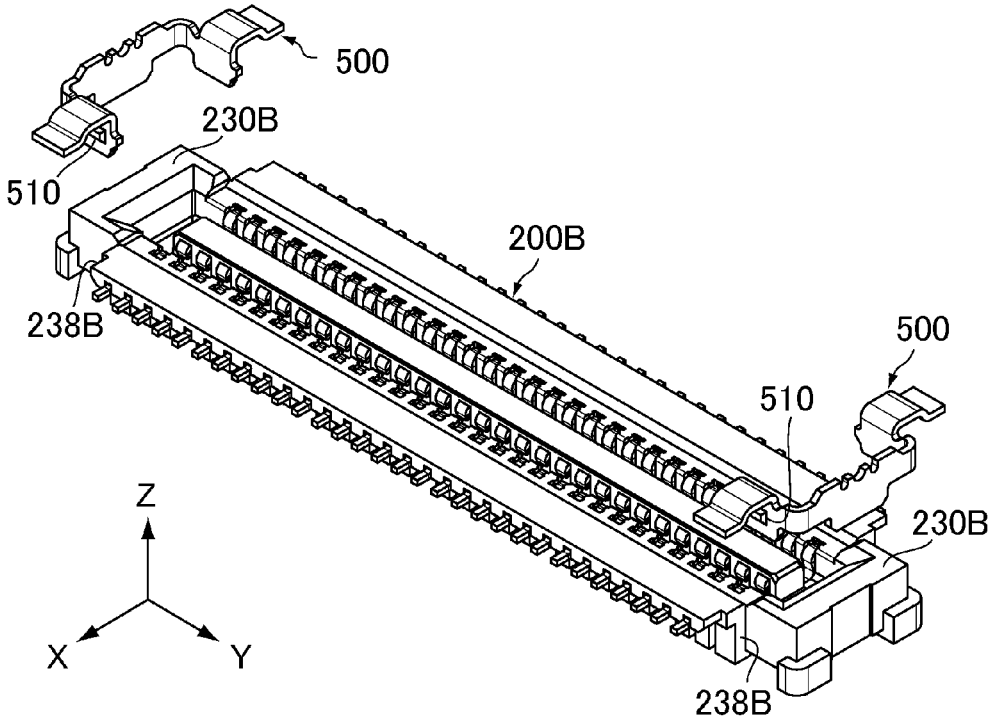
FIG. 16 is a perspective view showing a housing and holddowns of the connector of FIG. 12, wherein the contacts are attached to the housing while the holddowns are not attached to the housing.
Figure 17:
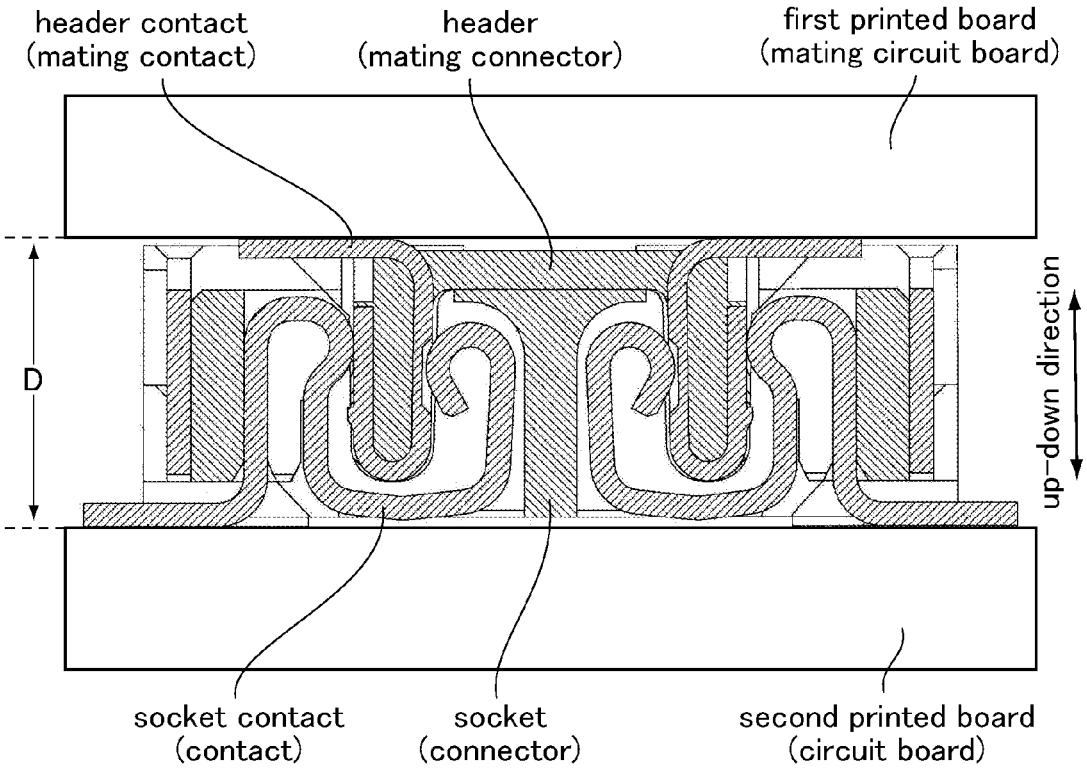
FIG. 17 PRIOR ART
FIG. 17 is cross-sectional view showing the connector and the mating connector of Patent Document 1.

As shown in FIGS. 12 and 16, the housing 200B is formed similar to the housing 200 except that the housing 200B has coupling walls 230B slightly different from the coupling walls 230 (see FIG. 4). In detail, each of the coupling walls 230B is formed with not the second fixing portion 236 but two attaching portions 238B. The attaching portions 238B are provided at opposite sides of the coupling wall 230B in the X-direction, respectively.

The holddowns 500 are press-fit into and attached to the attaching portions 238B from above. Thus, the holddowns 500 are fixed to and held by the housing 200B. Each of the holddowns 500 is provided with two attaching portions 510. The attaching portion 510 according to the present embodiment is a protrusion protruding outward in the X-direction. The attaching portions 510 sandwich the coupling wall 230B in the X-direction.

Figure 15:
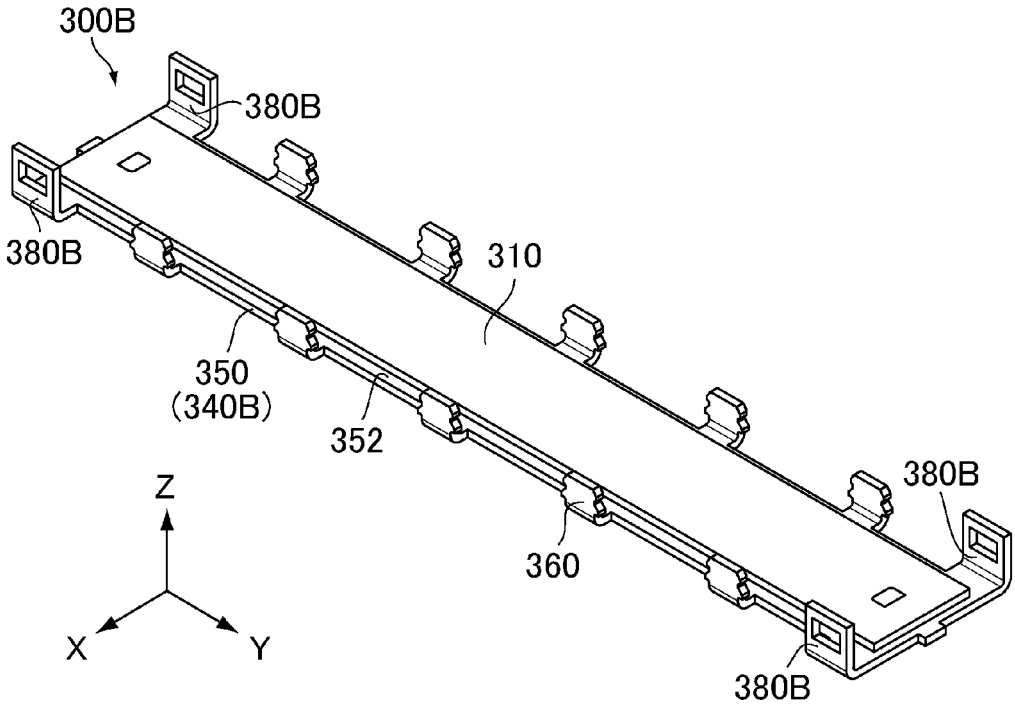
FIG. 15 is a perspective view showing a regulation member of the connector of FIG. 12.

As shown in FIG. 15, the regulation member 300B has the insulation portion 310 and a metal portion 340B, wherein the insulation portion 310 is same as that of the present embodiment while the metal portion 340B is slightly different from the metal portion 340 (see FIG. 7) according to the present embodiment. In detail, the metal portion 340B has the body portion 350 and the first fixed portions 360 same as those of the metal portion 340, while not having the second fixed portions 370. Moreover, the metal portion 340B has attached portions 380B instead of the attached portions 380. Each of the attached portions 380B according to the present embodiment is formed with a hole which pierces the attached portion 380B in the X-direction.

Figure 13:
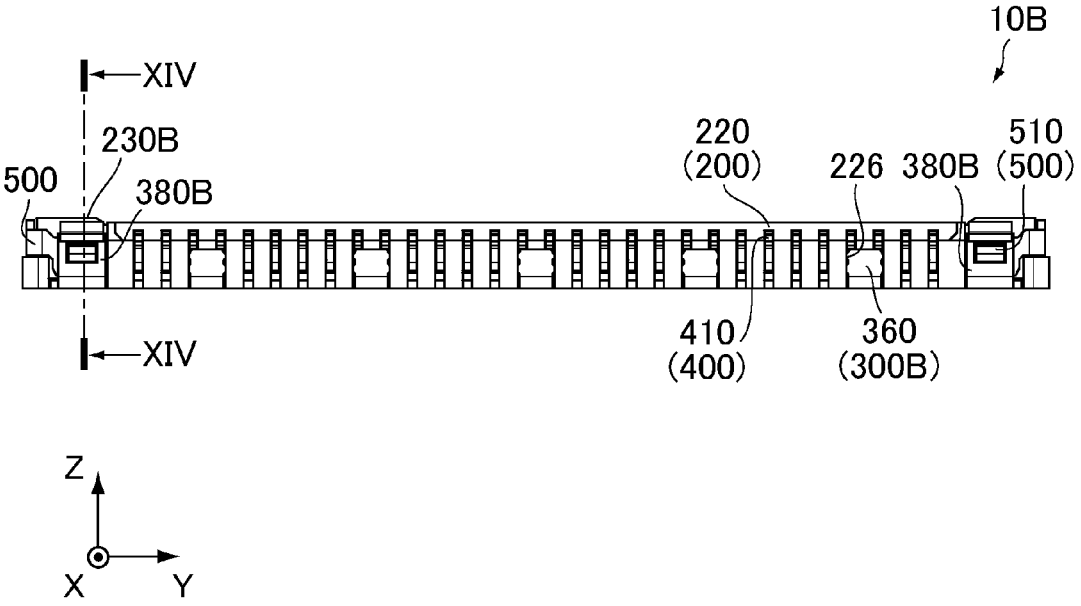
FIG. 13 is a side view showing the connector of FIG. 12.
Figure 14:
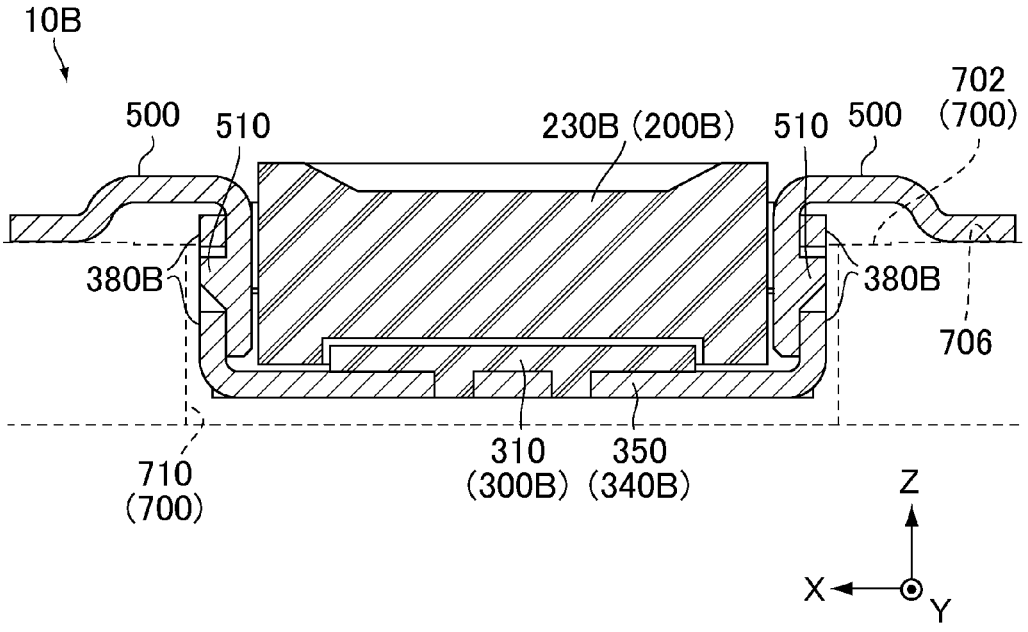
FIG. 14 is a cross-sectional view showing the connector of FIG. 13, taken along line XIV-XIV, wherein an outline of the circuit board under the mounted state is illustrated by dotted line.

As shown in FIGS. 13 and 14, the attached portion 380B is attached to the holddown 500. According to the present modification, the hole of the attached portion 380B is engaged with the protrusion of the attaching portion 510 of the holddown 500. However, the attached portion 380B may be attached to the holddown 500 differently, provided that the attached portion 380B is securely held by the holddown 500.

Under the mounted state, the holddowns 500 are fixed to the conductive pads 706 of the upper surface 702 of the circuit board 700 (see FIG. 2) by soldering, or the like, to be grounded to the ground pattern (not shown) of the circuit board 700. Thus, the attached portions 380B of the metal portion 340 are indirectly fixed to the upper surface 702 of the circuit board 700 via the holddowns 500 under the mounted state. The effect same as that obtained by the metal portion 340 (see FIG. 7) of the present embodiment can be also obtained by the thus-formed metal portion 340B. For example, the metal portion 340B according to the modification can prevent EMI. As can be seen from the above explanation, the attached portion 380B may be directly or indirectly fixed to the circuit board 700 under the mounted state.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along an up-down direction under a mounted state where the connector is mounted on a circuit board, the mating connector being mounted on a mating circuit board, the connector comprising:

a housing having two outer walls, two coupling walls coupled to the outer walls, a bottom portion, and a protruding portion protruding upward from the bottom portion at a middle part of the housing;

a regulation member having an insulation portion made of an insulator and a metal portion made of a metal, the insulation portion being supported by the metal portion, the metal portion being fixed to the housing; and a contact which is press-fit in the housing from below to be held by the outer walls and the protruding portion, the contact having a connection portion and a resilient portion, the connection portion being fixed to an upper surface of the circuit board under the mounted state, the resilient portion having a lower-end portion, the lower-end portion of the resilient portion being located below the connection portion and located right above the insulation portion of the regulation member, the resilient portion being resiliently deformable downward.

2. The connector as recited in claim 1, wherein:

the lower-end portion of the resilient portion is movable downward; and the lower-end portion of the resilient portion is brought into contact with the insulation portion when the resilient portion is maximally resiliently deformed downward.

3. The connector as recited in claim 1, wherein:

the metal portion has a fixed portion; and the fixed portion is press-fit in the housing to be fixed to the housing.

4. The connector as recited in claim 1, wherein:

the insulation portion has a plate-like shape;

the metal portion has a body portion;

the body portion has a plate-like shape intersecting the up-down direction; and the insulation portion is fixed on the body portion.

5. The connector as recited in claim 4, wherein the insulation portion and the body portion are integrally formed via insert-molding.

6. The connector as recited in claim 5, wherein:

a predetermined portion of the insulation portion pierces the metal portion in the up-down direction; and a lower surface of the predetermined portion of the insulation portion is flush with a lower surface of the body portion.

7. The connector as recited in claim 4, wherein the insulation portion is an insulating tape fixed to an upper surface of the body portion.

8. The connector as recited in claim 1, wherein:

the metal portion has an attached portion; and the attached portion is directly or indirectly fixed to the circuit board under the mounted state.

9. The connector as recited in claim 4, wherein the body portion shields the housing from below.

10. The connector as recited in claim 8, wherein the attached portion is directly fixed to the upper surface of the circuit board under the mounted state.

11. The connector as recited in claim 8, wherein:

the connector comprises a holddown:

the holddown is held by the housing;

the attached portion is attached to the holddown; and the attached portion is indirectly fixed to the upper surface of the circuit board via the holddown under the mounted state.

12. The connector as recited in claim 1, wherein the contact is formed by punching out and bending a single metal plate.

13. The connector as recited in claim 1, wherein the mating circuit board is a Flexible Printed Circuit (FPC).

* * * * *